United States Patent [19]

Homann

[11] 4,271,754

[45] Jun. 9, 1981

[54] METHOD OF AND APPARATUS FOR PRESSING OF LIQUIDS FROM SOLID MATERIALS

[75] Inventor: Thorsten Homann, Hamburg, Fed. Rep. of Germany

[73] Assignee: Fried. Krupp GmbH, Essen, Fed. Rep. of Germany

[21] Appl. No.: 958,638

[22] Filed: Nov. 8, 1978

[30] Foreign Application Priority Data

Nov. 19, 1977 [DE] Fed. Rep. of Germany ..... 2751703

[51] Int. Cl.[3] ..... B30B 9/02

[52] U.S. Cl. ..... 100/37; 100/117

[58] Field of Search ..... 100/117, 145–150, 100/37; 366/90

[56] References Cited

U.S. PATENT DOCUMENTS

| | | | |
|---|---|---|---|
| 1,769,658 | 7/1930 | Veenhvyzen | 100/145 |
| 2,709,957 | 6/1955 | Armstrong | 100/150 X |
| 2,876,698 | 3/1959 | Sisley | 100/147 |
| 2,975,096 | 3/1961 | Ginaven et al. | 100/117 |
| 3,085,623 | 4/1963 | Ginaven et al. | 100/148 X |
| 3,411,435 | 11/1968 | French et al. | 100/147 |
| 3,672,641 | 6/1972 | Slaby | 366/90 X |

*Primary Examiner*—Billy J. Wilhite

*Attorney, Agent, or Firm*—Karl F. Ross

[57] ABSTRACT

In the pressing of liquids from solid materials, especially for the pressing of liquids from oil-containing solids such as edible-oil seeds, using a filter press, the pressing is carried out in a plurality of stages each of which is followed by a pressure reduction. According to the invention, the material in each stage is initially subjected exclusively to a progressively increasing pressure, is then spontaneously expanded to the ambient pressure and thereafter is at least partially subdivided into particles which are compressed in the next stage in accordance with the same pressing sequence.

7 Claims, 4 Drawing Figures

METHOD OF AND APPARATUS FOR PRESSING OF LIQUIDS FROM SOLID MATERIALS

FIELD OF THE INVENTION

The present invention relates to a method of and to an apparatus for the pressing of solids to recover liquids therefrom and, more particularly, to the recovery of edible oils from oil-bearing seeds and the like.

BACKGROUND OF THE INVENTION

In the production of edible oils from oil-bearing seeds, e.g. soya beans, cocoa beans, sesame seed and the like, it has already been proposed to provide processes in which the oil pressing is carried out in a so-called filter press of the worm type. In such systems it has also been suggested to carry out the pressing in a plurality of stages with a pressure reduction following each stage.

A worm or screw press for carrying out such a process is described, for example, in German open application - Offenlegungsschrift - DT-OS 1,944,642.

In this system, an adjustable control or limitation of the dynamic pressure is provided for a progressive pressure increase within the press.

This pressure increase is a result of a progressively reduced thread or helix cross section for each individual stage such that the press pressure ahead of throttle between the stages, gradually increases and immediately upstream of the throttle is reduced to a lower value corresponding to the value at which the pressure rise of the next stage is to commence.

As a result of this pressure development throughout the press, all of the particles of the material remain essentially in the same position vis-i-vis other particles practically throughout their travel through the press.

In practice, it has been found that after the material has been subjected to the first pressure peak in the initial stage, the application of higher pressures to obtain higher pressure peaks in subsequent stages gives rise to only a minimum improvement in the pressing effectiveness. As a practical matter, no substantial densification of the material occurs in the subsequent stages beyond that to which the material has been subjected in the first stage.

OBJECTS OF THE INVENTION

The principal object of the present invention is to provide a method of and an apparatus for the improved recovery of liquids from solids by the filter-press technique using a worm-type filter press.

Another object of the invention is to provide a method of pressing oils from edible oil or oil-bearing seeds and the like which has improved yield and efficiency over earlier oil-pressing methods.

It is still another object of the present invention to provide an improved method of and apparatus for the pressing of oil or other liquids from edible oil seed or other solid materials which gives a more effective recovery of the oil by comparison with processes using progressive pressure increase, pressure variation and like techniques in which the layering of the material in the filter press remains practically unchanged over the entire length thereof.

SUMMARY OF THE INVENTION

These objects and others which will become apparent hereinafter are attained, in accordance with the present invention, by subjecting the materials to be pressed in each stage of a plurality of succeeding stages of a worm-type oil press, i.e. a filter press, initially to an exclusively increasing pressure from the peak of which the material is spontaneously expanded to the ambient (atmospheric) pressure, i.e. the pressure of the surrounding atmosphere and is thereafter at least partly subdivided into small particles or pieces and relayered or mixed around before the material is compressed anew in the subsequent stage.

The zone of falling pressure after attaining the maximum or peak value in each stage is thus eliminated if the system of the present invention is compared with prior art systems.

The technique of the present invention has, most surprisingly, been found to preclude the resorption of the liquid particles which have been previously pressed from the pressing cake. However, perhaps the most significant advantage is that the expansion to the ambient pressure at the end of each stage, which takes place at a pressure drop far in excess of any pressure reduction possible in the prior art systems, assists in breaking up and relayering the material so that the positions of the particles during the next compression stage is markedly different from the particle orientation during the preceding stage. The subsequent stage is thus effective upon a loose packed mass which can have its original permeability so that the liquid pressed from the mass can effectively leave the latter and be recovered.

Since the material from one stage to the next has decreasing liquid contents, it has been found to be advantageous to increase the peak pressure of each stage from stage to stage in the direction of movement of the material through a press and to make the peak pressure in each stage the optimum for maximum liquid removal therein.

As noted previously, the process of the present invention is preferably carried out in a filter press of the worm-type. This filter press can use a single screw or worm subdivided over its length into a plurality of worm sections each constituting one of the pressing stages. The stages each can have helices or threads of the worm of constant pitch, worm or thread height, core and outer diameters or worms which vary the cross section for the material from the inlet side to the outlet side of the respective stage.

However, in either case, between each stage there is provided a throttle which maintains the pressure upstream of the throttle but allows expansion past the throttle to the ambient pressure.

In other words, the desired continuous increase in each stage from the inlet side to the discharge end of each stage can be assured by a corresponding dimensioning of the throttle or throttle opening with respect to the material displacement characteristics of the worm in dependence upon the nature of the material pressed and its starting liquid content.

A particular advantage of the system of the present invention, by comparison with prior art presses, is that it allows a considerable shortening of the press. This is because the pressure-reduction zones ahead of the throttles of the prior art press described above are completely eliminated.

In the pressureless regions of the press the discharge openings for the liquid in the housing of the press can be made of larger diameter or can be increased in number so as to assure effective run-off of the liquid in these regions.

According to still another feature of the invention, the worm is constituted of a continuous worm shaft extending the full length of the press and carrying a plurality of sleeves which can be keyed to the shaft and are provided with the worms or helices. At the junctions between these sleeves there are provided pressureless regions corresponding to the regions in which the material is expanded to ambient pressure.

This excludes the forced introduction of the material or the liquid into the gaps between the sleeves and any crevices between the shaft and the sleeves. These frequently aggressive impurities have been found to be capable of promoting corrosion of the equipment, requiring high maintenance costs and lower downtime of the apparatus.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
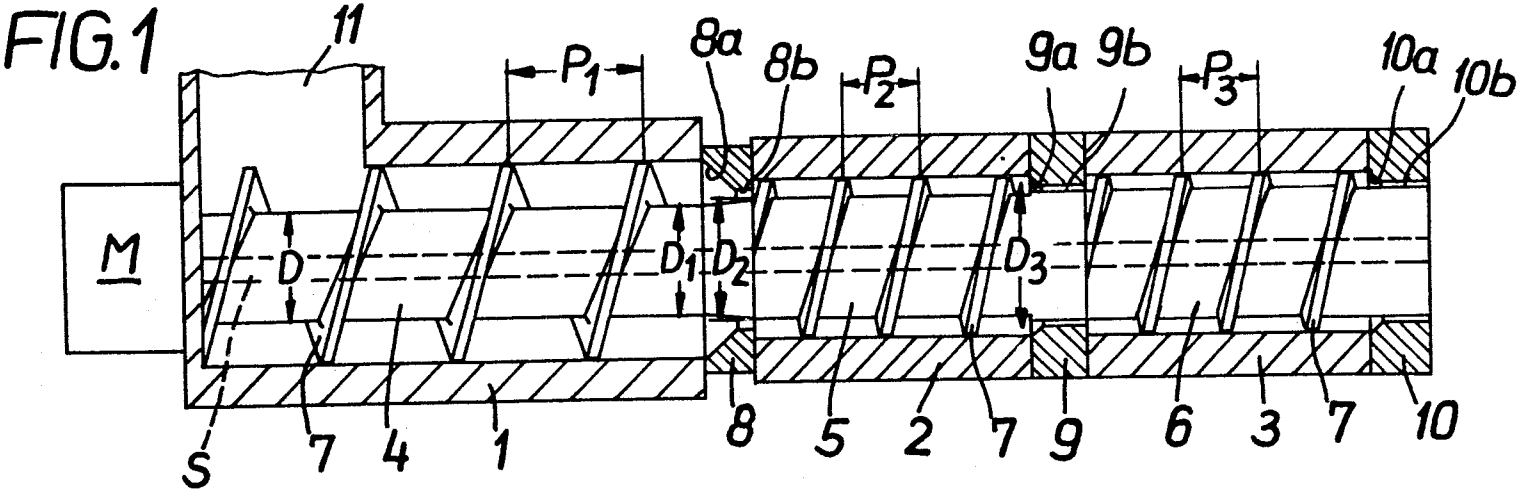
FIG. 1 is an axial cross sectional view diagrammatically illustrating a filter press according to the invention.
Figure 2A:
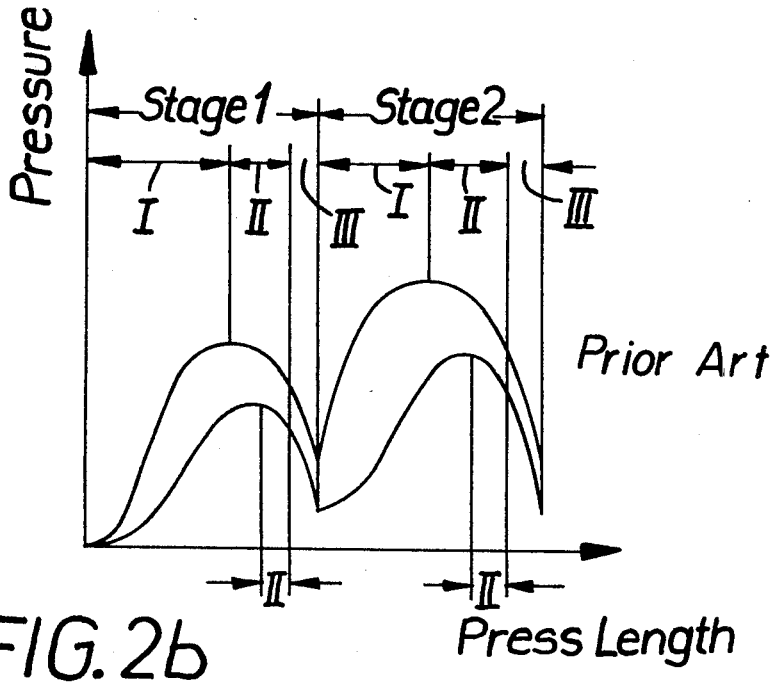
FIG. 2*a* is a graph representing the prior art development of pressure in the press described in the aforementioned German patent application.
Figure 2B:
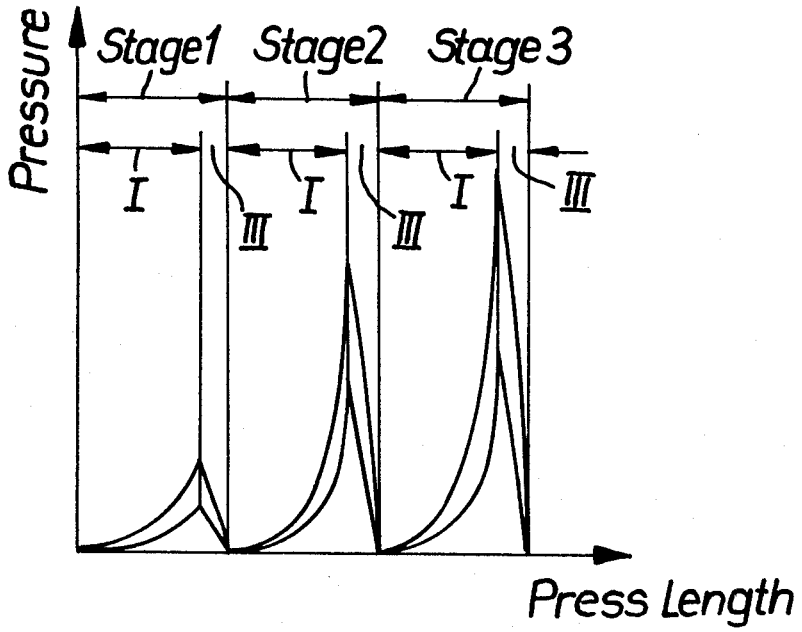
FIG. 2*b* is a graph corresponding to that of FIG. 2*a* but illustrating the pressure development of the system of the present invention.

The press shown in FIG. 1 has a housing defining a press cylinder subdivided into three cylinder sections 1, 2 and 3 corresponding to the three stages, stage 1, stage 2, and stage 3 illustrated in FIG. 2*b*.

The press is continuously traversed by a shaft S driven by the motor M and referred to hereinafter as the worm shaft.

Upon this worm shaft S there are keyed the three worm sleeves 4, 5, and 6, each of which defines one of the stages previously mentioned.

Each of the worm sleeves is formed with a worm or helix 7. The helices 7 extend the full length of the respective sleeves and hence the full length of the respective stages.

In each of these stages, the thread or worm 7 has a constant thread height, a constant root diameter and a constant outer diameter. Each worm section also has a constant pitch. In other words, in the first stage, the pitch $P_1$ is constant over the entire length of the first stage while the diameter D at the inlet side is equal to the diameter $D_1$ at the outlet side. However, the diameter $D_1$ can be less than the diameter $D_2$ (root diameter) of the next stage whose diameter $D_3$ at the discharge side is greater than the diameter $D_2$. The pitch $P_2$ of the second stage and the outer diameter of the thread 7 are reduced by comparison to the corresponding dimensions of the first stage. In the third stage, the outer diameter of the thread is shown to be the same although the root diameter is increased and hence the thread height is diminished. The pitch $P_3$ may also be slightly less than the pitch $P_2$.

At the end of each worm sleeve, there is provided an annular throttle 8, 9 or 10 which converges in the direction of movement of the material through the worm press. At the inlet side, a feed shaft 11 is provided through which the material to be pressed is introduced.

Each of the throttles 8, 9, 10 is dimensioned so that immediately downstream thereof, the pressure of the material is reduced to the ambient pressure. The throttle lies immediately upstream of the next worm section so that the material in transiting from one stage to the next is broken up and relayered upstream of each stage.

The pressure characteristics of the device have been shown in FIG. 2*b* by comparison with the pressure distribution in the prior art device mentioned previously and which has been illustrated in FIG. 2*a*.

The length of the worm sleeve corresponds to the region I while the expansion region has been represented at III. In the prior art system it will be seen that a pressure reduction zone II is disposed between the pressure built-up zone and the transition zone immediately ahead of the next pressure zone.

Figure 1A:
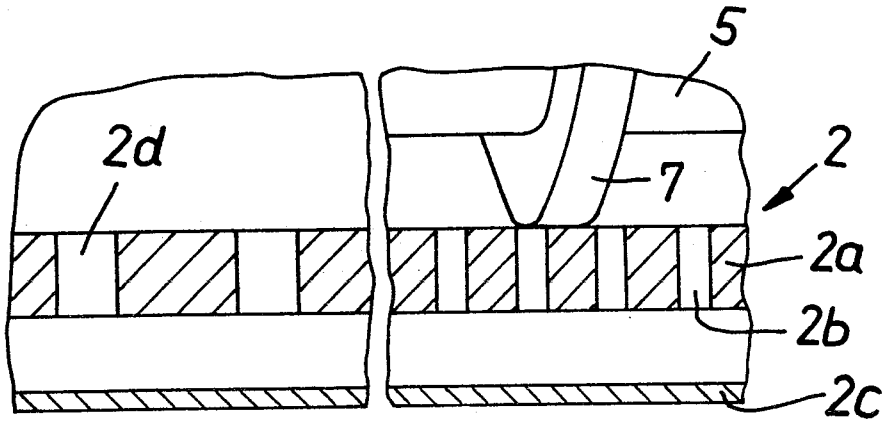
FIG. 1*a* is a fragmentary cross sectional view showing a portion of this press.

In FIG. 1*a*, there is illustrated an embodiment of the invention in which in the expansion region immediately adjacent the throttle 8, the bores 2*d* in the wall of the chamber, through which the liquid is discharged into the duct or jacket 2*c*, are of a much larger diameter than the bores 2*b* in the wall portion 2*a* at which pressure is higher. This ensures an effective flow of liquid away from the material even in the expanded within the screw press.

SPECIFIC EXAMPLE

The press shown in FIG. 1 is used to extract oil from seeds. The press used a worm whose root diameter in the first stage was 180 mm, whose thread height was 70 mm and whose outer diameter was 320 mm, the length of the first stage being 900 mm and the peak pressure developed in this zone, for a throughput of 120 kg/min of the material was 10 atm. The root diameter in the second stage was 200 mm, the thread height was 30 mm and the outer diameter was 260 mm, the peak pressure being 100 atmospheres.

In the final stage the root diameter was 200 mm, the length was 550 mm, the thread height was 30 mm, the outer diameter was 260 mm, but the pitch such as to yield a peak pressure of 150 atmospheres. This pressure could also be achieved by increasing the root diameter of the third stage as shown. The length of the second stage was 550 mm.

When processing edible oils from oil-bearing seeds, this described press produces a presscake with a residual oil content of about 16–19%. When a conventional press operating with the same throughput and of the same length was used, employing the pressure condition shown in FIG. 2*a*, the residual oil content of the presscake was about 23%. The expansion was to atmospheric pressure and the presses all were operated at a temperature of 100° C.

I claim:

1. A method of pressing a liquid in the form of oil from a solid material in the form of vegetable matter which comprises the steps of:

(a) pressing said material in a first stage to a peak pressure;

(b) immediately and directly thereafter spontaneously expanding the material from said peak pressure to atmospheric pressure;

(c) disrupting the orientation and continuity of the material as formed during the pressing in step (a); and (d) immediately and directly repeating steps (a) through (c) at least once, each sequence of steps (a) through (c) constituting a respective stage.

2. The process defined in claim 1 wherein the peak pressure of step (a) in each of said stages increases from stage to stage.

3. The process defined in claim 2 wherein at least three such stages are used.

4. The process defined in claim 1 which is carried out in a screw press with each of said stages being formed along a respective section of a worm, each section of said worm having a constant pitch, thread height, and root diameter.

5. A method of operating a screw press for the filter pressing of oil from vegetable matter, comprising the steps of pressing said vegetable matter to a first peak pressure along a first section of said screw press as controlled by a throttle downstream of said first section;

expanding the material compressed in said first section to atmospheric pressure and disrupting the orientation of the pressed material from said first section;

pressing the material with disrupted orientation from atmospheric pressure to a peak pressure higher than the first-mentioned peak pressure along a second section of the screw of said screw press following said throttle;

passing the material from said second section through a further throttle downstream of said second section; and expanding the material from the peak pressure of said second section to the atmospheric pressure.

6. A screw press for the pressing of liquids from solids by the method of claim 1 which comprises:

a perforated housing allowing liquids to escape;

a screw rotatable in said housing and formed with a succession of worm sections spaced along said screw, each of said worm sections being provided with a thread having a constant thread height, thread pitch, root diameter and outer diameter; and respective throttles between each succeeding section and the preceding section for sustaining a peak pressure upstream of the respective throttles, said press and said throttles being dimensioned to allow expansion from the peak pressure immediately upstream of the respective throttle to atmospheric pressure of material traversing the respective throttle.

7. The press defined in claim 6 wherein said screw is provided with a worm shaft extending continuously over the entire length of said housing and through all of said section, and respective worm sleeves in each section surrounding and keyed to said shaft, junctions between said sleeves being disposed in regions in which ambient pressure is maintained along said worm.

* * * * *